US010010729B1

(12) United States Patent
Murphy et al.

(10) Patent No.: US 10,010,729 B1
(45) Date of Patent: Jul. 3, 2018

(54) HARNESS HAVING A DEPLOYABLE RAPPELLING ASSEMBLY

(71) Applicant: Hyprum LLC, Pataskala, OH (US)

(72) Inventors: Robert K. Murphy, Ada, MI (US); Tom J. Africa, Lebanon, OH (US); Patrick R. Walker, Pataskala, OH (US)

(73) Assignee: HYPRUM LLC, Pataskala, OH (US)

( * ) Notice: Subject to any disclaimer, the term of this patent is extended or adjusted under 35 U.S.C. 154(b) by 0 days.

(21) Appl. No.: 15/446,214

(22) Filed: Mar. 1, 2017

(51) Int. Cl.
*A62B 35/00* (2006.01)
*A41D 1/04* (2006.01)
*A41D 3/00* (2006.01)

(52) U.S. Cl.
CPC ..... *A62B 35/0018* (2013.01); *A41D 1/04* (2013.01); *A41D 3/00* (2013.01); *A62B 35/0025* (2013.01)

(58) Field of Classification Search
CPC . A62B 35/00; A62B 35/0006; A62B 35/0025; A62B 35/0037; A62B 35/0075; B64D 17/30; A41D 13/0007
See application file for complete search history.

(56) References Cited

U.S. PATENT DOCUMENTS 3,424,134 A * 1/1969 Rosenblum ..... A62B 35/0018 182/3
3,559,932 A * 2/1971 Ternes ..... B64D 17/30 244/151 R
3,973,643 A 8/1976 Hutchinson
4,076,101 A 2/1978 Himmelrich
4,090,683 A * 5/1978 Derrien ..... B64D 17/30 244/151 A
4,378,921 A * 4/1983 Allen ..... B64D 17/30 182/6
4,553,633 A 11/1985 Armstrong
4,645,033 A 2/1987 Oelschlager
4,731,882 A 3/1988 Ekman
(Continued)

FOREIGN PATENT DOCUMENTS

EP 2781235 A1 9/2014
FR 2604097 A1 3/1988

OTHER PUBLICATIONS

Yates, "361 Special Ops Full Body Harness", Yates Tactical, pp. 1-2, (2016).

(Continued)

*Primary Examiner* — Katherine W Mitchell
*Assistant Examiner* — Shiref M Mekhaeil
(74) *Attorney, Agent, or Firm* — Cook Alex Ltd.

(57) ABSTRACT

A harness having a deployable rappelling assembly is disclosed. The harness includes a strap construction including an upper torso securing portion having shoulder straps that extend from a rear torso portion to a front torso portion, a leg securing portion extending downward from the rear torso portion and having right and left leg straps, each of the left and right leg straps including a releasable connector, and a rappelling assembly connected to the front torso portion. The rappelling assembly may fold from a stowed position to a deployed position, and include loops and a cross member. The leg straps may be passed through the loops to connect the front torso portion to the leg securing portion for climbing or rappelling. The harness also may be incorporated into a garment.

13 Claims, 7 Drawing Sheets

(56) References Cited

U.S. PATENT DOCUMENTS 5,145,027 A * 9/1992 Petzl ..... A62B 35/0025 119/770
5,228,412 A 7/1993 Bell
5,531,292 A * 7/1996 Bell ..... A62B 35/0018 182/3
5,823,663 A 10/1998 Bell et al.
5,960,480 A 10/1999 Neustater et al.
6,035,440 A * 3/2000 Woodyard ..... A41D 13/0007 182/3
6,101,631 A * 8/2000 Ferguson, Jr. ..... A41D 13/0007 182/3
6,125,966 A * 10/2000 Jones ..... A62B 35/0018 182/3
6,128,782 A 10/2000 Young et al.
6,283,248 B1 9/2001 Groover
RE37,394 E 10/2001 Woodyard
6,308,335 B1 * 10/2001 Colorado ..... A41D 13/0007 182/6
6,367,582 B1 * 4/2002 Derby ..... A62B 35/0018 119/857
6,405,685 B1 * 6/2002 Cox ..... A62B 35/0018 119/857
6,658,666 B2 * 12/2003 Schweer ..... A41D 13/0007 182/3
6,662,372 B2 * 12/2003 Lewis ..... A41D 13/0007 182/3
6,691,824 B2 * 2/2004 Sharp ..... A62B 35/04 182/18
6,698,026 B2 * 3/2004 Schweer ..... A41D 13/0007 182/3
6,808,046 B1 10/2004 Henson
6,874,596 B2 * 4/2005 Zeissler ..... A62B 35/00 182/3
6,892,395 B2 * 5/2005 Schweer ..... A41D 13/0007 182/3
7,036,628 B2 * 5/2006 Wilcox ..... A01M 31/02 119/770
7,047,567 B2 5/2006 Allen
7,066,181 B2 6/2006 West
7,086,091 B2 8/2006 Jordan
7,451,495 B2 11/2008 Munn et al.
7,979,919 B2 7/2011 Joran
8,056,675 B2 11/2011 Helms
8,092,037 B2 1/2012 Kassay et al.
8,235,173 B2 * 8/2012 Kopp ..... A45F 3/14 182/3
8,281,894 B2 10/2012 Mordecai et al.
8,353,386 B2 1/2013 Helms
8,443,937 B2 5/2013 Mordecai et al.
8,776,266 B1 7/2014 Metz
D725,825 S 3/2015 Seman et al.
9,015,880 B1 4/2015 Cauthen et al.
9,055,772 B2 6/2015 Stinson et al.
9,155,925 B2 * 10/2015 Botti ..... A62B 35/0012
9,168,401 B2 10/2015 Botti
9,174,071 B2 11/2015 Seman et al.
9,586,688 B2 * 3/2017 Blignaut ..... B64D 17/30
2003/0146044 A1 * 8/2003 Jordan ..... A62B 35/0037 182/3
2003/0173150 A1 9/2003 Sharp
2004/0140152 A1 7/2004 Richardson
2005/0263347 A1 * 12/2005 Hill ..... A62B 35/0018 182/3
2006/0195962 A1 9/2006 Jordan
2007/0295555 A1 12/2007 O'Rourke
2008/0282442 A1 11/2008 Bauvois
2009/0159365 A1 6/2009 O'Brien
2009/0320188 A1 12/2009 Johnson et al.
2011/0017546 A1 * 1/2011 Nichols, Jr. ..... A62B 35/0018 182/3
2011/0030118 A1 2/2011 Pratchett
2012/0113628 A1 5/2012 Burrow et al.
2013/0048418 A1 2/2013 Nichols, Jr.
2014/0060968 A1 3/2014 Semen et al.
2014/0082830 A1 3/2014 Ruhl et al.
2014/0224582 A1 8/2014 Wood
2014/0224583 A1 8/2014 Wood
2014/0237698 A1 8/2014 Murphy et al.
2014/0325733 A1 11/2014 Rae et al.
2015/0202475 A1 * 7/2015 Botti ..... A62B 35/0012 182/3
2015/0217150 A1 8/2015 Harris
2015/0359272 A1 12/2015 Murphy et al.
2016/0008638 A1 1/2016 Hafner
2016/0096044 A1 4/2016 Franke et al.
2016/0206903 A1 * 7/2016 Boothby ..... A62B 35/0037
2016/0236017 A1 * 8/2016 Gross ..... A62B 35/0025
2016/0332009 A1 * 11/2016 Chevalier ..... A62B 35/0012
2016/0332010 A1 * 11/2016 Lowell ..... A62B 35/0018
2016/0361579 A1 * 12/2016 Casebolt ..... A62B 35/0037
2017/0162020 A1 * 6/2017 Pham ..... A61B 5/0024

OTHER PUBLICATIONS

International Search Report and Written Opinion dated Dec. 7, 2017, International Application No. PCT/US17/52895, Filed Sep. 22, 2017.

* cited by examiner

HARNESS HAVING A DEPLOYABLE RAPPELLING ASSEMBLY

FIELD OF THE DISCLOSURE

The present disclosure is directed to harnesses used for fall protection or lifting an individual, such as body harnesses or harnesses built into garments, and more particularly to such harnesses that also may be used for climbing or rappelling.

BACKGROUND

Many individuals have a need to wear a harness that is secured to a portion of the body. Full torso harnesses are commonly used by individuals involved in activities that present risks of falling or the potential need to be lifted or otherwise extracted from a location. Thus, users may wear a harness that is part of a system that provides protection against falling or a means to lift a person. These harnesses may be used, for example, by military personnel, first responders, workers in professions that present such circumstances, or recreation enthusiasts.

There also are harnesses that traditionally are used for more specific activities, such as rappelling. These types of harnesses tend to be formed in a manner that seeks to place the user in a generally seated position for rappelling, while not securing the full torso. These harnesses also tend to include leg straps that come together with other strapping around the lower torso and that is secured together at the front of the pelvic region.

It is believed that the prior art does not provide a harness that is light weight, relatively simple yet secure in structure and which permits a fall arresting or lifting type of body harness to be quickly and conveniently converted to utilize structure appropriate for climbing or rappelling.

SUMMARY

The present disclosure includes example devices that are based on harnesses, but which can include harnesses that are incorporated into garments, such as vests, coats, jackets or the like. The harnesses are constructed for relatively universal use, in the sense that the same device may be worn by individuals for many types of uses, such as for fall arresting or protection, and extraction or lifting of a user. The harnesses also uniquely include a deployable rappelling assembly that may be quickly and conveniently deployed and utilized when encountering a need to climb or rappel.

The harness structures may use straps or webbing and fabric, in constructions that include only a harness or that may include a harness that is connected to a garment. The harness includes an upper torso securing portion and a leg securing portion. The upper torso securing portion may include a connector, such as a D-ring or other device, which may be connected to a line or other apparatus for use in fall protection, lifting the user, or otherwise connecting an individual wearing the harness to another individual or to some other structure. The leg securing portion wraps around or encircles the upper portion of each leg with a strap having a releasable connector. There is a transition from the upper torso securing portion to the leg securing portion that occurs along the rear of the harness. The upper torso securing portion includes a rear torso portion and a front torso portion. Leg straps having two portions extend from the tailbone area of the rear torso portion. A first portion of each leg strap extends outward and then forward toward the outer hip. A second portion of each leg strap extends forward to pass under the crotch of the user, and then outward toward the outer hip.

A stowable, deployable rappelling assembly is connected to the torso front portion of the harness. While referred to as a rappelling assembly, it will be appreciated that the rappelling assembly may be deployed for use in climbing or rappelling. The example rappelling assembly is deployed by folding the rappelling assembly downward to a position that provides loops to connect the leg securing portion to the front torso portion, in front of the body. When the rappelling assembly is deployed, each leg strap is disconnected, rerouted to extend through a loop of the rappelling assembly, and then reconnected to again encircle the legs. The rappelling assembly includes left and right loops that are connected together by a cross member. A connector, such as a carabiner clip, clasp or other device, may be secured to the cross member and then anchored to a line, belay device, or other apparatus for use during climbing or descending.

This novel arrangement has the base structure of the harness secured to the upper torso by spanning across the back of the user, unlike a traditional rappelling harness that focuses on securing to the lower torso and legs, in front of the pelvic region. The rear torso portion of the novel harness is connected to the leg securing portion when not intending to use the harness for climbing or rappelling. Thus, when the rappelling assembly is not deployed, the legs are secured by straps that travel from the rear torso portion, under the crotch and are connected to encircle the upper leg. In this configuration, the legs are not secured to the front-torso area, which allows greater flexibility and ease of movement along the user's front side. When the rappelling assembly is deployed, threading the leg straps through the loops and reconnecting them utilizes the loops and cross member of the rappelling assembly to create an integrated secure connection of the upper torso securing portion to the leg securing portion both in the rear and front of the torso.

In a first aspect, the present disclosure relates to a harness having a deployable rappelling assembly. The harness includes a strap construction including an upper torso securing portion having shoulder straps that extend from a rear torso portion to a front torso portion, a leg securing portion extending downward from the rear torso portion and having right and left leg straps, each of the left and right leg straps including a releasable connector, and a rappelling assembly connected to the front torso portion.

The rappelling assembly may fold from a stowed position to a deployed position, and include loops and a cross member. The leg straps may be passed through the loops to connect the front torso portion to the leg securing portion for climbing or rappelling.

Harnesses consistent with the present disclosure provide convenient, compact, lightweight, easy to use devices that can be conveniently and unobtrusively worn by an individual. The rappelling assembly of the harness may be deployed without the use of tools, and provides an advantageous configuration to permit climbing and/or rappelling. The harness may be connected to or otherwise incorporated into a garment, such as by sewing or connecting the harness straps directly to an inner or outer side of an outer wear unit, or by locating it between a lining and an outer wear unit. Releasable connectors on the leg straps permit the selective use of the rappelling assembly.

It also will be appreciated that the garments to which such a harness may be connected may include protective garments worn by individuals serving in various different capacities or participating in various activities. Thus, the garments may be constructed, for example, to be worn by soldiers or police personnel in the form of armored vests, while those worn by firefighters may be constructed in the form of fireproof coats or the like. Vests for recreational use may be constructed with highly reflective surfaces or with water resistant, thermal or other properties, as desired.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein.

Figure 1:
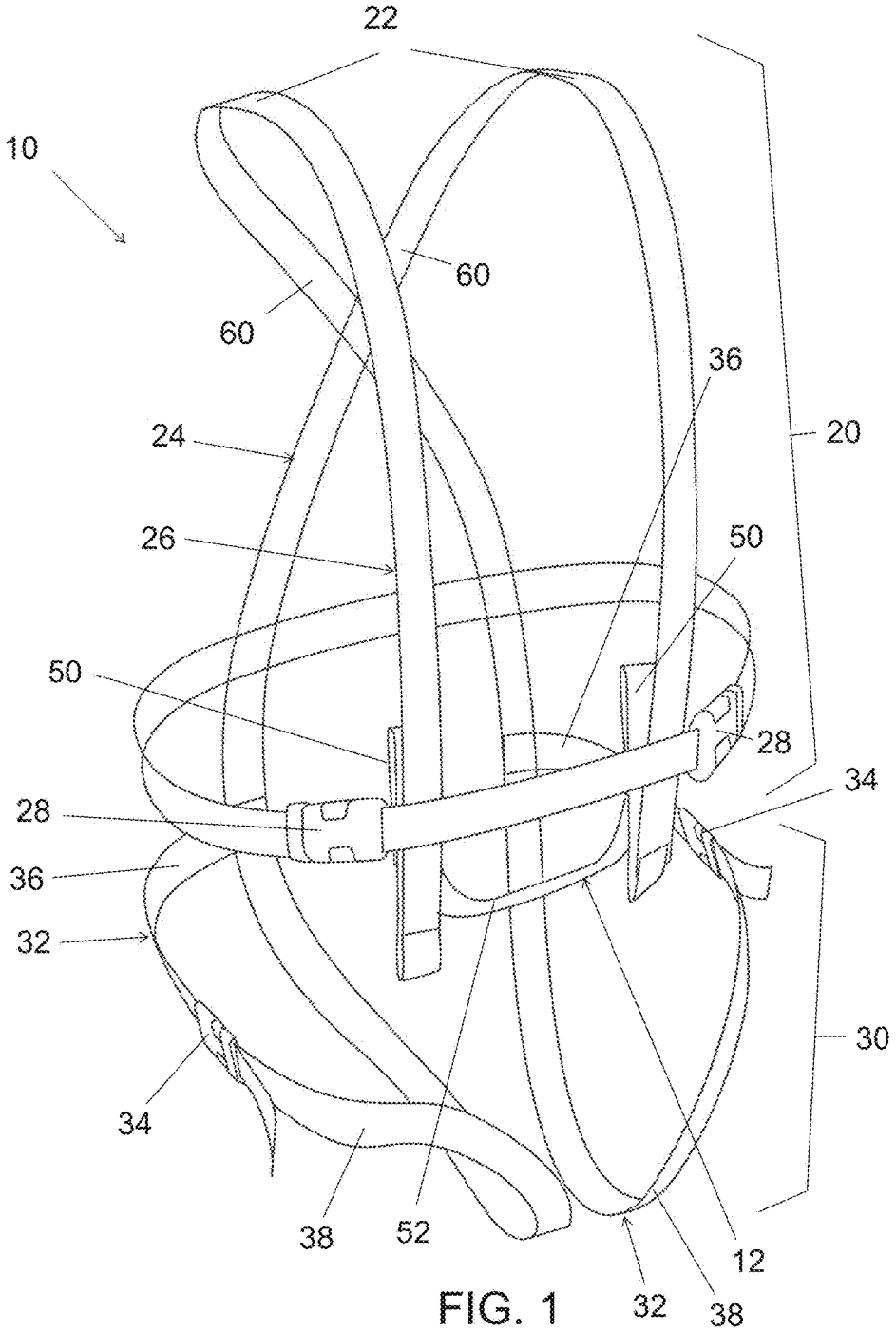
FIG. 1 is a front perspective view of a harness that includes a rappelling assembly in a stowed position.

Corresponding or related reference numerals indicate corresponding parts throughout the several views. Although the drawings represent exemplary embodiments of the present disclosure, the drawings are not necessarily to scale and certain features may be exaggerated, removed or shown in phantom to better illustrate and explain the present disclosure.

DETAILED DESCRIPTION

Examples of the present subject matter are disclosed herein. However, it will be understood that the disclosed examples merely are exemplary, and that harnesses within the scope of the appended claims may be embodied and constructed in various forms. Therefore, specific details disclosed herein are not to be interpreted as limiting, but as illustrative of various aspects of the present subject matter.

As described in more detail herein, the present disclosure is directed to harnesses having a rappelling assembly, such as may be utilized by military personnel, first responders, individuals having the need for fall protection or lifting, and that may have a need to climb or rappel. In general, harnesses of the present disclosure are intended to be worn by individuals in inherently dangerous settings, such as when dealing with fall protection or a potential need to be lifted, but also provide the option of deploying a rappelling assembly for use in climbing or rappelling. The harnesses also may be connected to a garment, such as a vest or coat worn by the individual for protection or to increase convenience of carrying other items.

Figure 6:
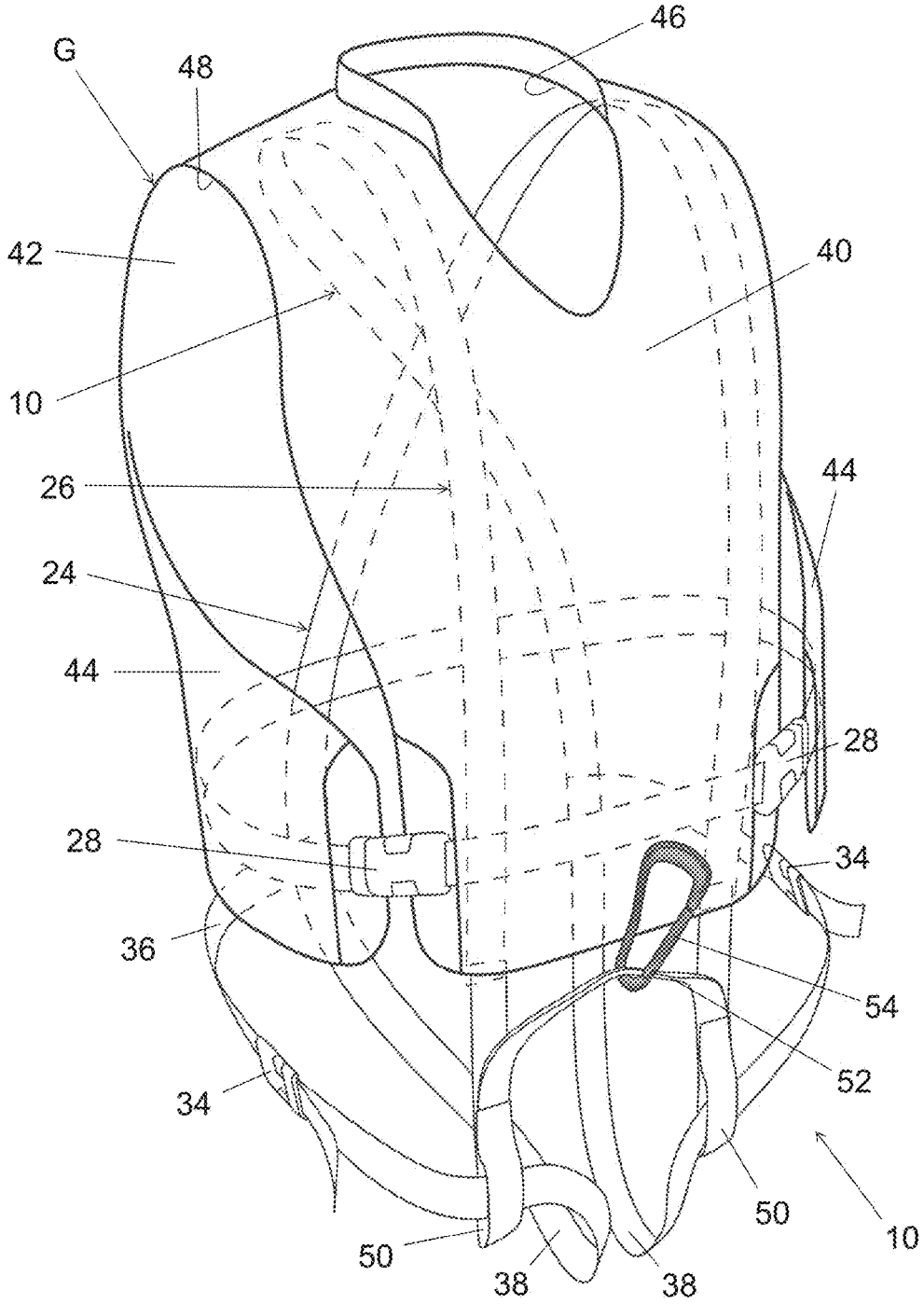
FIG. 6 is a front perspective view of the harness of FIG. 1, as shown in FIG. 4 but also connected to a garment in the form of a vest.
Figure 7:
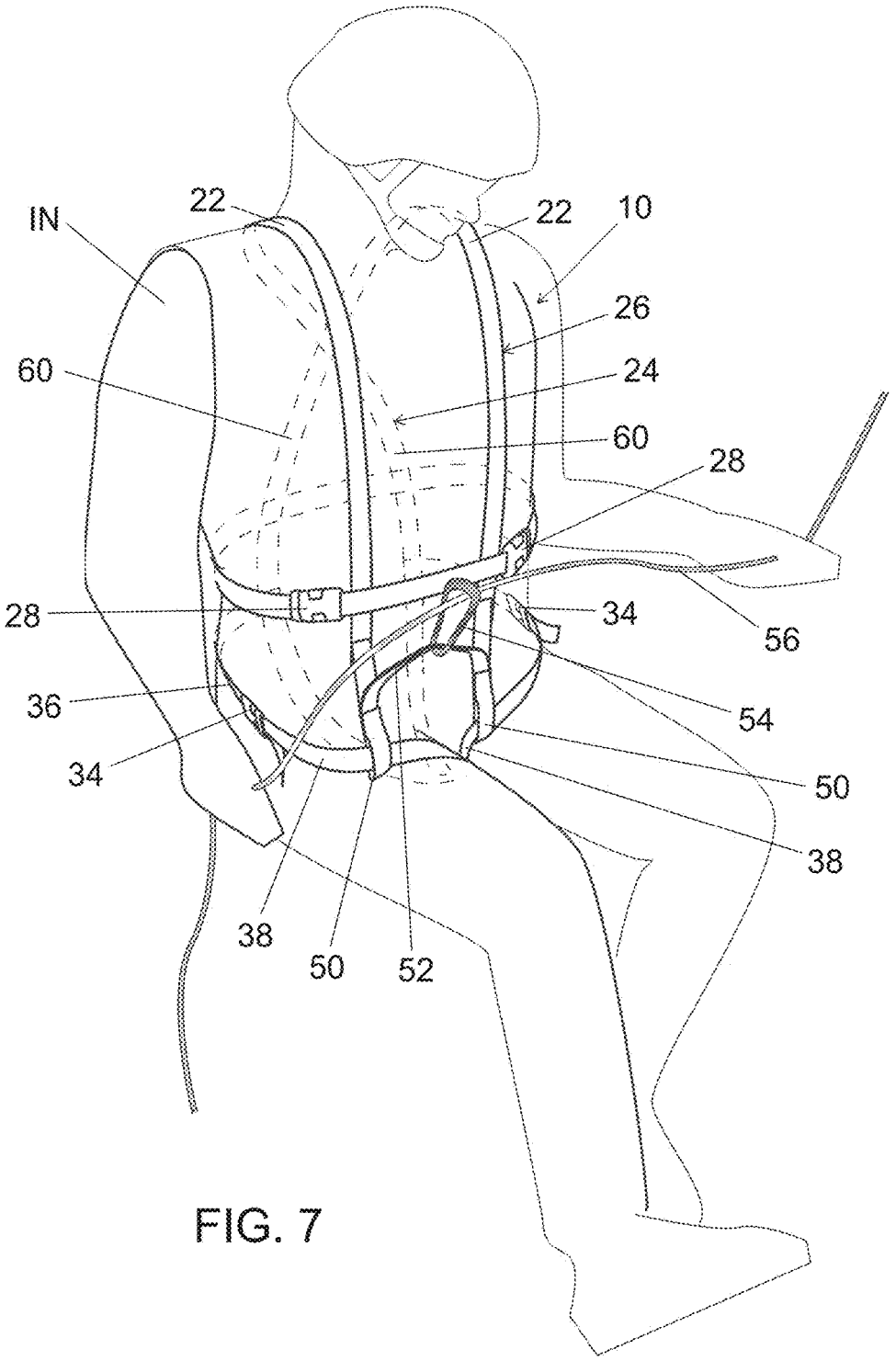
FIG. 7 is a front perspective view of the harness of FIG. 1, as shown in FIG. 4 and having a line passing through the connector that is connected to the cross member of the rappelling assembly while being worn by an individual.

FIGS. 1-5 show an example of a harness 10 having a rappelling assembly 12, with FIG. 6 showing the harness 10 connected to a garment G, and FIG. 7 showing the harness 10 worn by an individual IN, also referred to herein as a user. The harness 10 includes a strap construction including an upper torso securing portion 20 having shoulder straps 22 that extend from a rear torso portion 24 to a front torso portion 26, a leg securing portion 30 extending downward from the rear torso portion 24 and having right and left leg straps 32, each of the left and right leg straps 32 including a releasable connector 34, and a rappelling assembly 12 connected to the front torso portion 26. Each leg strap includes a first portion 36 extending outward and forward and a second portion 38 extending forward and outward, wherein the first portion 36 connects to the second portion 38 via the releasable connector 34, wherein each leg strap 32 encircles one of the user's legs. In the example shown, the releasable connector 34 is shown as a side release clasp buckle, although it will be appreciated that other releasable connectors may be used.

It should be noted that the term upper torso securing portion 20 or leg securing portion 30, with the various respective straps that complete the rear and front torso portions 24, 26 and the leg straps 32 generally may include a construction of having a group of flexible, relatively high strength elements, such as woven straps, rope or other lines that may be connected together in a configuration to generally surround the torso of a user, but which may include other molded integrally formed webbing structures. Thus, in the present disclosure, the term strap should be understood to mean a flexible element, and need not be relatively wide and thin. The construction of the harness 10 may include suitable relatively light weight, strong and flexible materials, such as Kevlar®, Nylon, plastics or the like. In addition, the harness 10 may be connected to a garment in a variety of ways, such as by being sewn or snapped to an inner and/or an outer surface of an outer wear unit, or located between an inner liner, made of a suitable material, and the outer wear unit.

The harness 10 may be donned and worn by an individual IN by placing the head of the user between the shoulder straps 22 and folding the front torso portion 26 downward relative to the rear torso portion 24. Thus, the front torso portion 26 folds relative to the rear torso portion 24 via the shoulder straps 22. The front torso portion 26 includes left and right releasable connectors 28 that connect the front torso portion 26 to the rear torso portion 24. The releasable connectors 28 may be of any known type, including the example side release clasp buckles shown. It will be appreciated that the arms of a user will extend outward from between the rear and front torso portions 24, 26 of the harness 10.

As noted, if desired, a harness 10 may be connected to a garment G. While other configurations for vests, coats or other garments may be used, depending on the configuration chosen, as in the present example shown in FIG. 6, a garment G may include a front portion 40, a rear portion 42, side portions 44, a neck hole 46, and arm holes 48, which in this example are formed by the relative positions of the front, rear and side portions 40, 42 and 44, respectively. It will be appreciated that the harness 10 in this example includes portions that extend along an inner surface of the garment G, while other portions extend along an outer surface of the garment G. For instance, it will be appreciated that the upper torso securing portion 20 may be concealed within the garment G.

The example garment G is illustrated in a simplified manner in the form of a vest, such as may be used as body armor or as a ballistic vest, such as may be worn by military, law enforcement or other personnel. As previously noted, it will be appreciated that the harness 10 could be connected to the garment G in other ways to either conceal or expose the harness 10, as desired. The construction of the garment G may include suitable materials to accomplish the intended purpose. For instance, among other materials, a body armor vest may include any one of several bullet resistant woven fabrics, such as Kevlar®, and may enclose or cover metal or ceramic bulletproof plates. However, it should be noted that the garments may be constructed for various other purposes, such as, for example, in the form of a fire coat, which may include fireproof materials, as a climbing vest that may be breathable, light weight synthetic fabric, or any other desired and suitable material.

Figure 2:
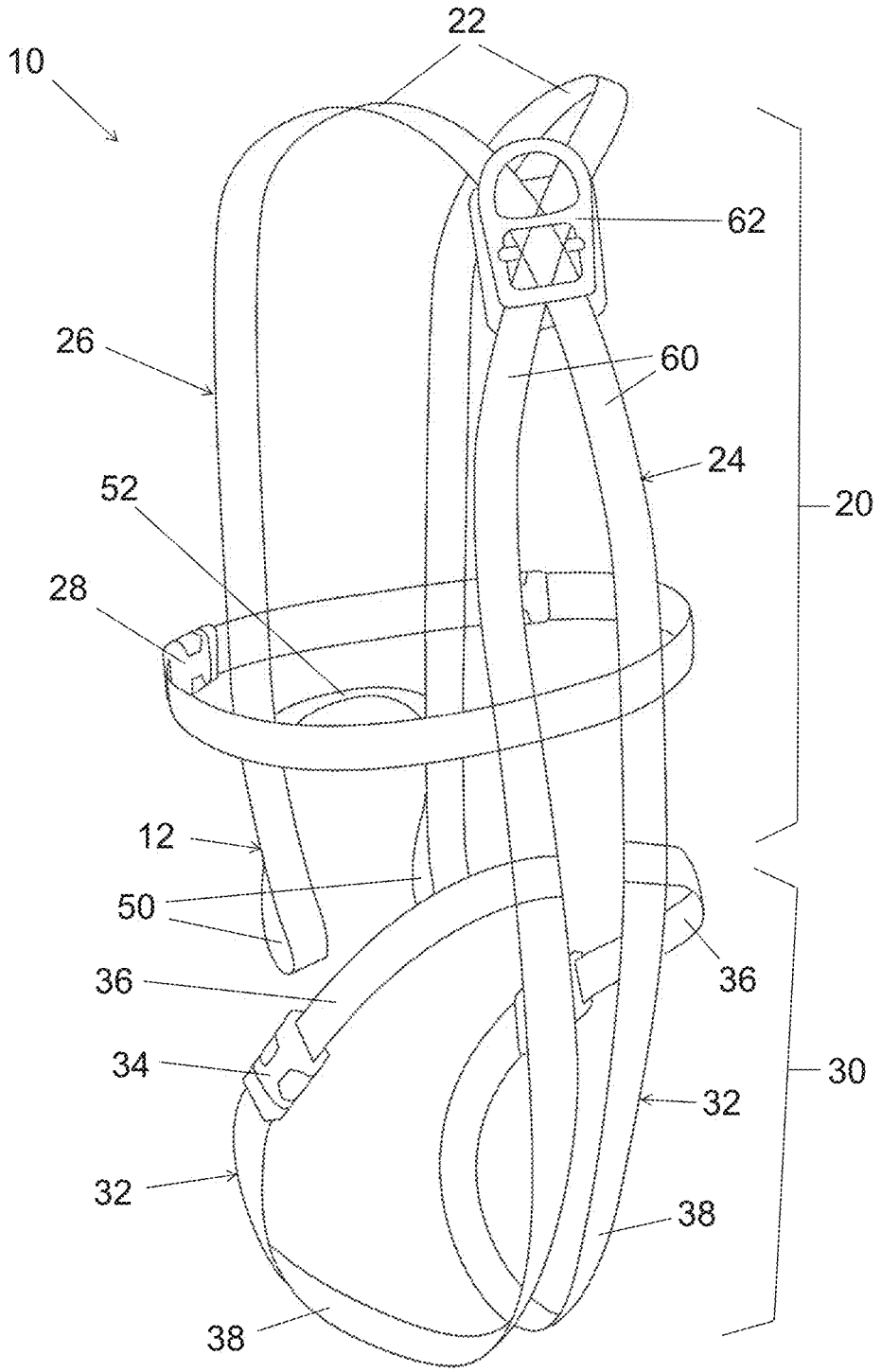
FIG. 2 is a rear perspective view of the harness of FIG. 1, shown with an example optional connector on the rear torso portion.
Figure 3:
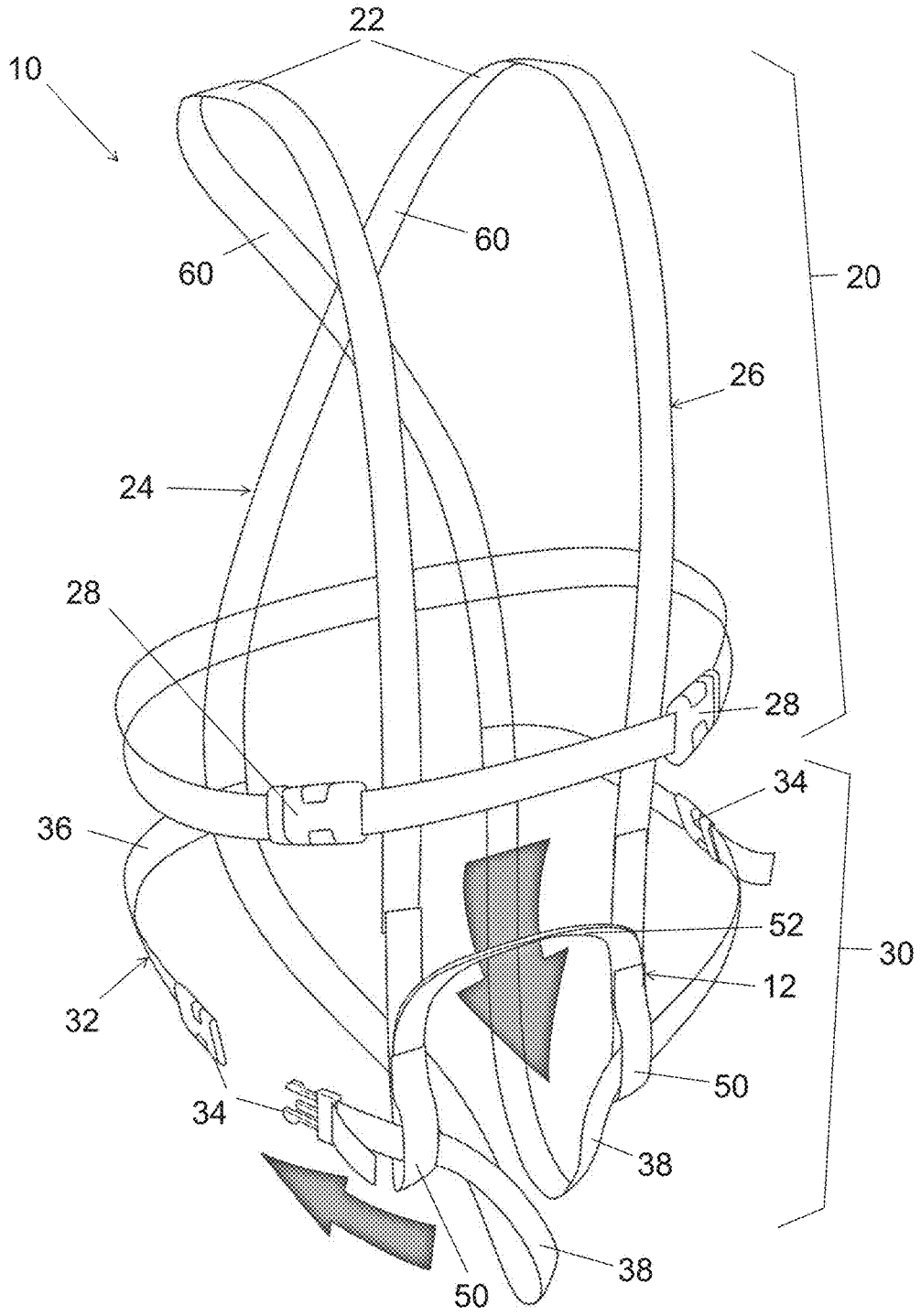
FIG. 3 is a front perspective view of the harness of FIG. 1, shown in the process of deploying the rappelling assembly and being connected to the leg straps.
Figure 4:
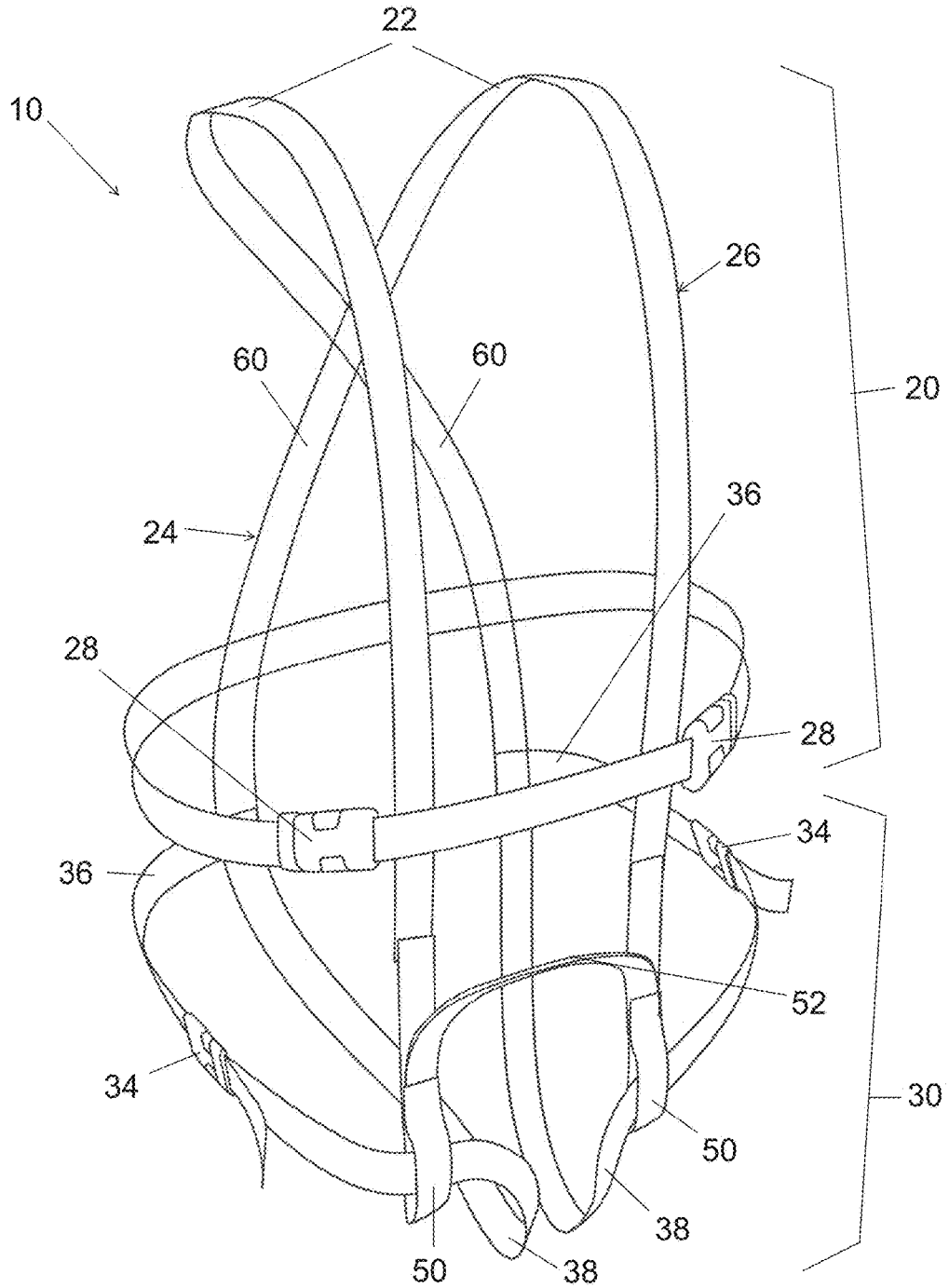
FIG. 4 is a front perspective view of the harness of FIG. 1, shown with the rappelling assembly deployed and connected to the leg straps.
Figure 5:
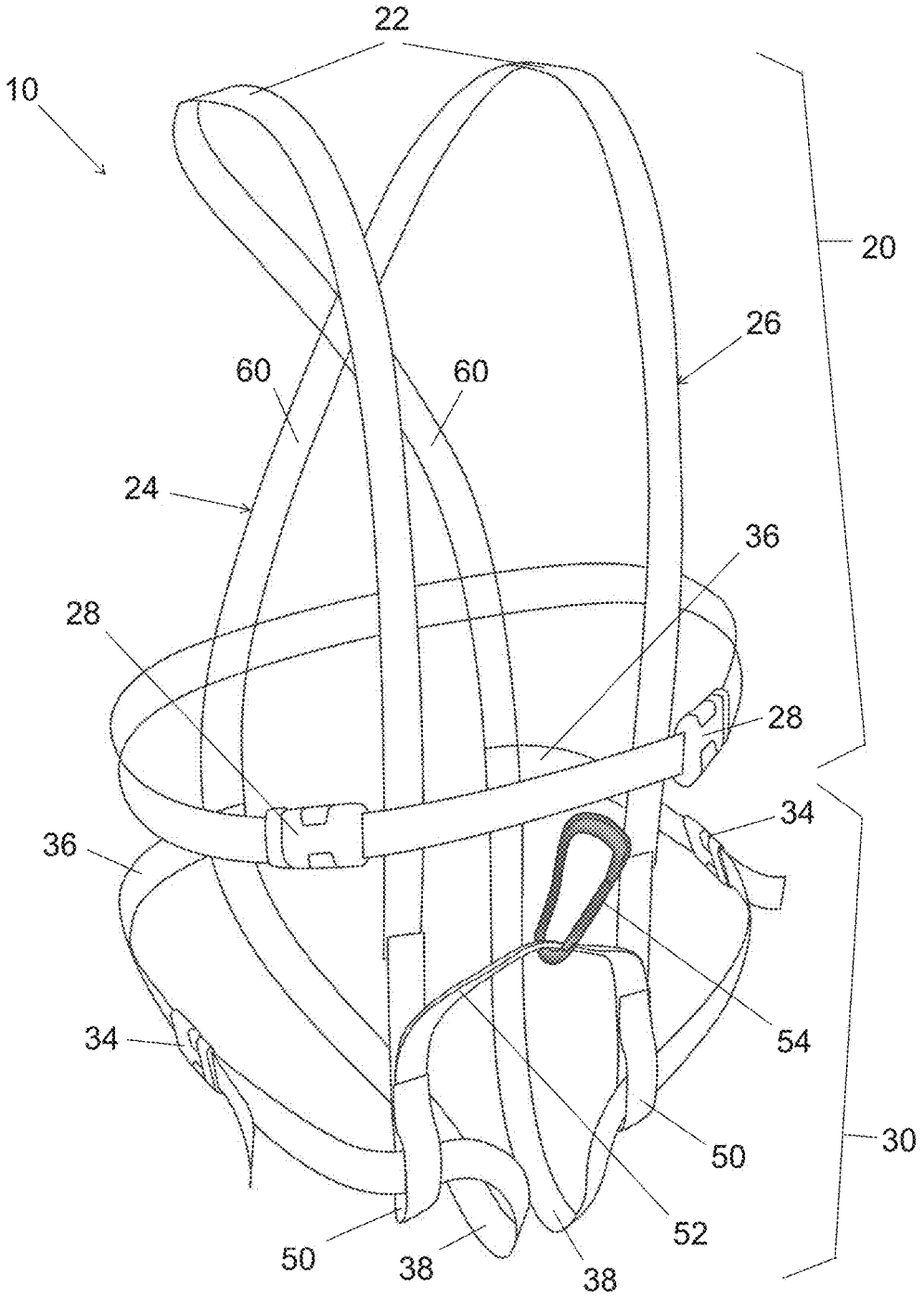
FIG. 5 is a front perspective view of the harness of FIG. 1, as shown in FIG. 4 but having a connector connected to a cross member or the rappelling assembly.

The rappelling assembly 12 is foldable from a stowed position, shown in FIG. 1, to a deployed position, shown in FIGS. 2 and 3. Thus, in this example, the rappelling assembly 12 folds upward to a stowed position and downward, as indicated in FIG. 3, to a deployed position. The rappelling assembly 12 further includes left and right loops 50. The left and right loops 50 of the rappelling assembly 12 receive the respective left and right leg straps 32 when the rappelling assembly 12 is usable for rappelling. The rappelling assembly 12 also includes a crossing member 52 that is connected to the left and right loops 50. The crossing member 52 is particularly useful for rappelling when further including a connector 54, such as a carabiner clip, clasp or other device, which may receive a line 56, a belay device, or other apparatus for use during climbing or descending.

Thus, the rear torso portion 24 of the novel harness 10 is connected to the leg securing portion 30 when not intending to use the harness for climbing or rappelling. Thus, when the rappelling assembly 12 is not deployed, the legs are secured by leg straps 32 that travel from the rear torso portion 24, under the crotch and are connected to encircle the upper leg. In this configuration, the legs are not secured to the front-torso portion 26, which allows greater flexibility and ease of movement along the user's front side. When the rappelling assembly 12 is deployed, threading the leg straps 32 through the loops 50 and reconnecting them at the connectors 34 utilizes the loops 50 and cross member 52 of the rappelling assembly 12 to create an integrated secure connection of the upper torso securing portion 10 to the leg securing portion 30 both in the rear and front of the torso.

As noted, the harness 10 provides an upper torso securing portion 20 that contributes to the ability to also serve a purpose such as fall protection or to facilitate the lifting of the user. For instance, as shown in FIG. 2, the rear torso portion 24 of the upper torso securing portion 20 may further include crossing straps 60, and may further include a connector 62, such as a D-ring or other device that receives a line or other implement. It will be appreciated that the connector 62 is shown as an example in FIG. 2, but such a connector is not necessarily required or may be constructed in a different manner.

It should be noted that when using the term a strap construction including an upper torso securing portion, this is being used to mean a construction that includes a group of flexible, relatively high strength elements, such as woven straps, rope or other lines that are connected together in a configuration to generally surround the torso of a user, and may include other molded integrally formed webbing structures. Thus, in the present disclosure, the term strap should be understood to mean a flexible element, and need not be relatively wide and thin. The construction of the harness 10 may include suitable relatively light weight, strong and flexible materials, such as Kevlar®, Nylon, plastics or the like. In addition, the harness 10 may be connected to a garment G in a variety of ways, which may be related to the materials used in forming the harness 10. Thus, the harness 10 may, for instance, be sewn, snapped or otherwise fastened to an inner and/or an outer surface of an outer wear unit, or located between an inner liner, made of a suitable material, and the outer wear unit of a garment. The connectors 28, 34 may be constructed of suitable materials, such as plastics, composite materials, aluminum, titanium, steel or other metal alloys, or the like.

It will be understood that the examples described above are illustrative of some of the applications of the principles of the present subject matter. Thus, while examples were provided and discussed with respect to an illustrated harness and garment, it is contemplated that harnesses and garments may be constructed for many different applications wherein individuals could don a commonly configured garment having a harness that may include many of the above-mentioned advantages. Further additions or alterations may be made to garments having a harness or to methods of using such devices, and may be made without departing from the spirit and scope of the present disclosure. Numerous modifications may be made by those skilled in the art without departing from the spirit and scope of the claimed subject matter, including but not limited to combinations of features that are individually disclosed or claimed herein. For these reasons, the scope of this disclosure is not limited to the above examples but is as set forth in the appended claims.

What is claimed is:

1. A harness having a deployable rappelling assembly, comprising:

a strap construction including an upper torso securing portion having shoulder straps that extend from a rear torso portion to a front torso portion;

a leg securing portion extending downward from the rear torso portion and having right and left leg straps;

each of the left and right leg straps including a releasable connector;

wherein the deployable rappelling assembly includes first and second front strap portions that each extend from the front torso portion, with the first front strap portion having a right loop and the second front strap portion having a left loop, and the deployable rappelling assembly further comprising a crossing member connected to and extending between the right and left loops; and wherein the deployable rappelling assembly is foldable upward to a stowed position when not configured for rappelling wherein the right and left loops are located proximate the front torso portion and wherein said right and left leg straps do not pass through said right and left loops respectively when in said stowed position, and wherein the deployable rappelling assembly is foldable downward to a deployed position when configured for use in rappelling wherein the first and second front strap portions extend downward from said stowed position and the front torso portion and are connected to the respective right and left leg straps by having the right leg strap extend through the right loop and the left leg strap extend through the left loop.

2. The harness of claim 1, wherein each leg strap is configured to encircle a user's leg.

3. The harness of claim 1, wherein each leg strap releasable connector further comprises a side release clasp buckle.

4. The harness of claim 1, wherein each leg strap includes a first portion extending outward and forward and a second portion extending forward and outward, wherein the first portion connects to the second portion.

5. The harness of claim 1, wherein the crossing member further comprises a connector that is configured to receive a line when rappelling.

6. The harness of claim 1, wherein the rear torso portion further comprises crossing straps.

7. The harness of claim 1, wherein the rear torso portion further comprising a connector that is configured to receive a line when rappelling.

8. The harness of claim 1, wherein the harness is connected to a garment.

9. The harness of claim 8, wherein the upper torso securing portion is concealed within the garment.

10. The harness of claim 1, wherein the front torso portion folds relative to the rear torso portion via the shoulder straps.

11. The harness of claim 1, wherein the front torso portion further comprises a releasable connector that connects the front torso portion to the rear torso portion.

12. The harness of claim 1, further comprising left and right front torso portion releasable connectors that connect the front torso portion to the rear torso portion.

13. The harness of claim 12, wherein each front torso portion releasable connector further comprises a side release clasp buckle.

* * * * *